US008167405B2

(12) United States Patent
Terakura

(10) Patent No.: US 8,167,405 B2
(45) Date of Patent: May 1, 2012

(54) LIQUID EJECTION HEAD AND METHOD OF PRODUCING THE SAME

(75) Inventor: Tatsuo Terakura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 477 days.

(21) Appl. No.: 12/394,034

(22) Filed: Feb. 26, 2009

(65) Prior Publication Data

US 2009/0219341 A1 Sep. 3, 2009

(30) Foreign Application Priority Data

Feb. 29, 2008 (JP) ..... 2008-050669

(51) Int. Cl.
*B41J 2/14* (2006.01)

(52) U.S. Cl. ..... 347/47

(58) Field of Classification Search ..... 347/40, 347/43, 47, 71; 29/890.1, 25.35
See application file for complete search history.

(56) References Cited

U.S. PATENT DOCUMENTS 6,652,062 B2 11/2003 Umeyama et al.
6,729,717 B2 5/2004 Ito et al.
7,152,952 B2 * 12/2006 Chikamoto ..... 347/47
7,311,380 B2 * 12/2007 Watanabe et al. ..... 347/40
7,610,679 B2 * 11/2009 Ito ..... 29/890.1
2002/0012021 A1 1/2002 Umeyama et al.

FOREIGN PATENT DOCUMENTS

JP H09-020009 A 1/1997
JP 2001-277513 A 10/2001
JP 2001-277514 A 10/2001
JP 2002-144590 A 5/2002
JP 2005-022183 A 1/2005

OTHER PUBLICATIONS

Japan Patent Office; Notification of Reason for Refusal in Japanese Patent Application No. 2008-050669 (counterpart to the above-captioned US Patent Application) mailed on Jun. 1, 2010.

* cited by examiner

*Primary Examiner* — Lamson Nguyen
(74) *Attorney, Agent, or Firm* — Baker Botts L.L.P.

(57) ABSTRACT

A liquid ejection head, including: plates including a nozzle plate in which nozzles for ejecting liquid are formed, and stacked on each other with the nozzle plate being as an outermost plate, wherein the nozzle plate includes a first area in which the nozzles are formed and a second area adjacent to the first area and located on a plate-side of the first area in a plates-stack direction, on which plate-side at least one of the plates different from the nozzle plate is located, wherein the nozzle plate further includes a first nozzle plate positioner formed in the first area and a second nozzle plate positioner larger than the first nozzle plate positioner and formed in the second area, and wherein each of the at least one of the plates includes a plate positioner formed therein and at least partly overlapping the first nozzle plate positioner in the plates-stack direction.

24 Claims, 11 Drawing Sheets

LIQUID EJECTION HEAD AND METHOD OF PRODUCING THE SAME

CROSS REFERENCE TO RELATED APPLICATION

The present application claims priority from Japanese Patent Application No. 2008-050669, which was filed on Feb. 29, 2008, the disclosure of which is herein incorporated by reference in its entirety.

BACKGROUND OF THE INVENTION

1. Field of the Invention

The present invention relates to a liquid ejection head configured to eject liquid onto a recording medium and a method of producing the liquid ejection head.

2. Description of the Related Art

There is conventionally known an ink-jet head as a liquid ejection head configured to eject liquid onto a recording medium. Further, Patent Document 1 (Japanese Patent Application Publication No. 2005-22183) discloses, as a method of producing the ink-jet head, a technique that a plurality of plates in each of which are formed holes and recesses for constituting ink-flow passages are stacked on and bonded to each other while being positioned to each other using positioning holes formed in each of the plates. According to the Patent Document 1, positioning holes are formed in a plate (i.e., a nozzle plate) in which a plurality of nozzles for ejecting ink are formed, and opened in an ink-ejection surface of the nozzle plate in which the nozzles are opened. Each of the positioning holes has a size that a positioning pin is insertable therein like positioning holes formed in other plates.

SUMMARY OF THE INVENTION

Where the relatively large positioning holes are opened in the ink-ejection surface like in the Patent Document 1, when a wiping operation for removing ink adhering to the ink-ejection surface is performed after what is called purging for recovering ink ejection failure of the nozzles is performed, the ink raked by the wiper tends to intrude into the positioning holes. Further, since the positioning holes of the nozzle plate are respectively communicated with the positioning holes formed in each of the other plates, the ink intruded into the positioning holes of the nozzle plate is intruded further inwardly into the positioning holes, whereby a large amount of the ink tends to be accumulated in the positioning holes. As a result, the ink accumulated in the positioning holes drops during recording, thereby arising a problem that the recording medium gets soiled.

Further, where the relatively large positioning holes are opened in the ink-ejection surface like in the Patent Document 1, a distal end of the wiper is contacted with opening edges of the respective positioning holes in a wiping operation, thereby leading to a problem in which the wiper tends to be damaged and deteriorated.

This invention has been developed in view of the above-described situations, and it is an object of the present invention to provide (a) a liquid ejection head which can reduce an intrusion of liquid into positioning holes of a nozzle plate in a wiping operation and damage and deterioration of a wiper, and (b) a method of producing the liquid ejection head.

The object indicated above may be achieved according to the present invention which provides a liquid ejection head, comprising: a plurality of plates including a nozzle plate in which a plurality of nozzles for ejecting liquid are formed, and stacked on each other with the nozzle plate being as an outermost plate, wherein the nozzle plate includes (a) a first area in which the plurality of nozzles are formed and (b) a second area adjacent to the first area and located on a plate-side of the first area in a plates-stack direction in which the plurality of plates are stacked on each other, on which plate-side at least one of the plurality of plates different from the nozzle plate is located, wherein the nozzle plate further includes (a) a first nozzle plate positioner formed in the first area of the nozzle plate and (b) a second nozzle plate positioner larger than the first nozzle plate positioner and formed in the second area of the nozzle plate, and wherein each of the at least one of the plurality of plates different from the nozzle plate includes a plate positioner formed therein and at least partly overlapping the first nozzle plate positioner in the plates-stack direction.

The object indicated above may also be achieved according to the present invention which provides a method of producing a liquid ejection head, comprising the steps of: (a) forming a nozzle plate by forming a first nozzle plate positioner and a plurality of nozzles for ejecting liquid in a first area of a plate which is adjacent to a second area of the plate and by forming a second nozzle plate positioner larger than the first nozzle plate positioner in the second area of the plate; (b) setting a positioning pin to the second nozzle plate positioner; (c) stacking, on the nozzle plate, at least one plate different from the nozzle plate after step (b) such that a plate positioner formed in each of the at least one plate at least partly overlaps the first nozzle plate positioner; (d) bonding the plates to each other; (e) removing the positioning pin from the second nozzle plate positioner after step (d); and (f) bending the nozzle plate after step (e) such that the second area is located on a plate-side of the first area in a plates-stack direction in which the nozzle plate and the at least one plate different from the nozzle plate are stacked on each other, on which side the at least one plate is located.

In the liquid ejection head apparatus constructed as described above and the method of producing the same, positioning of the nozzle plate and the at least one of the plurality of plates different from the nozzle plate can be performed by adjusting an overlap of the first nozzle plate positioner and the plate positioner in the plates-stack direction. Further, since the second nozzle plate positioner is larger than the first nozzle plate positioner, positioning of the nozzle plate can be easily performed.

The object indicated above may also be achieved according to the present invention which provides a method of positioning a plurality of plates including a nozzle plate and constituting a liquid ejection head, the method comprising the steps of: checking a position of the nozzle plate in which a positioning hole and a plurality of nozzles for ejecting liquid are formed; and positioning at least one of the plurality of plates which is different from the nozzle plate and in each of which a positioning hole larger than the positioning hole of the nozzle plate is formed, with respect to the nozzle plate while checking the positioning hole of the nozzle plate using the positioning hole of the at least one of the plurality of plates.

In the method of positioning the plurality of plates including a nozzle plate and constituting a liquid ejection head, since the positioning hole of the at least one of the plurality of plates is larger than the positioning hole of the nozzle plate, positioning of the nozzle plate and the other of the at least one of the plurality of plates can be easily performed.

BRIEF DESCRIPTION OF THE DRAWINGS

The objects, features, advantages, and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Hereinafter, there will be described preferred embodiments of the present invention by reference to the drawings.

Figure 1:
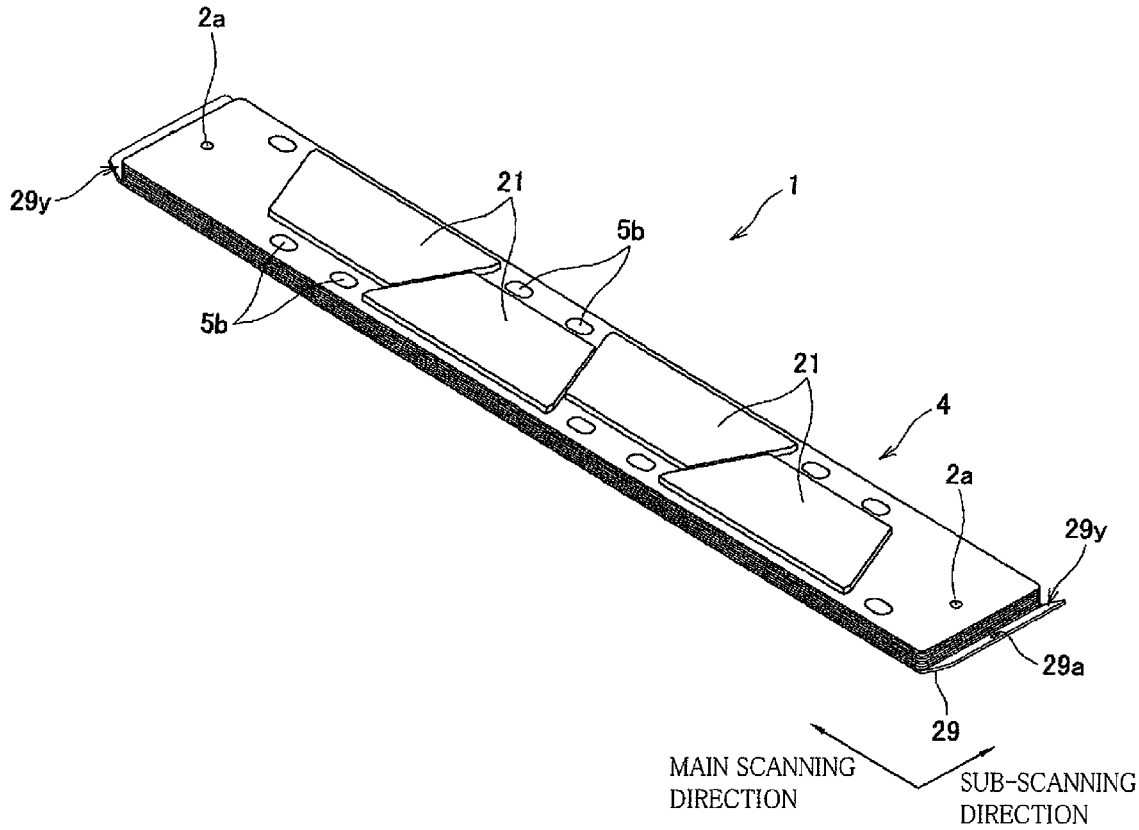
FIG. 1 is a perspective view schematically showing an ink-jet head as a first embodiment of an liquid ejecting head according to the present invention.

Initially, there will be explained a construction of an ink-jet head as a first embodiment of an liquid ejecting head according to the present invention with reference to FIGS. 1-5. As shown in FIG. 1, an ink-jet head 1 as the first embodiment of the present invention includes a flow-passage unit 4 and four actuator units 21. The flow-passage unit 4 has a generally rectangular parallelepiped shape elongated in a main scanning direction in which the ink-jet head 1 reciprocates in recording. In the flow-passage unit 4, ink-flow passages are formed. The four actuator units 21 are fixed on the flow-passage unit 4 and each has a trapezoid shape. It is noted that, though not shown in any figures, the ink-jet head 1 further includes reservoir units for storing ink (liquid) supplied to the flow-passage unit 4, a Flexible Printed Circuit (FPC) for supplying drive signals to the actuator units 21, a control board for controlling an driver IC mounted on the FPC, and so on.

Figure 3:
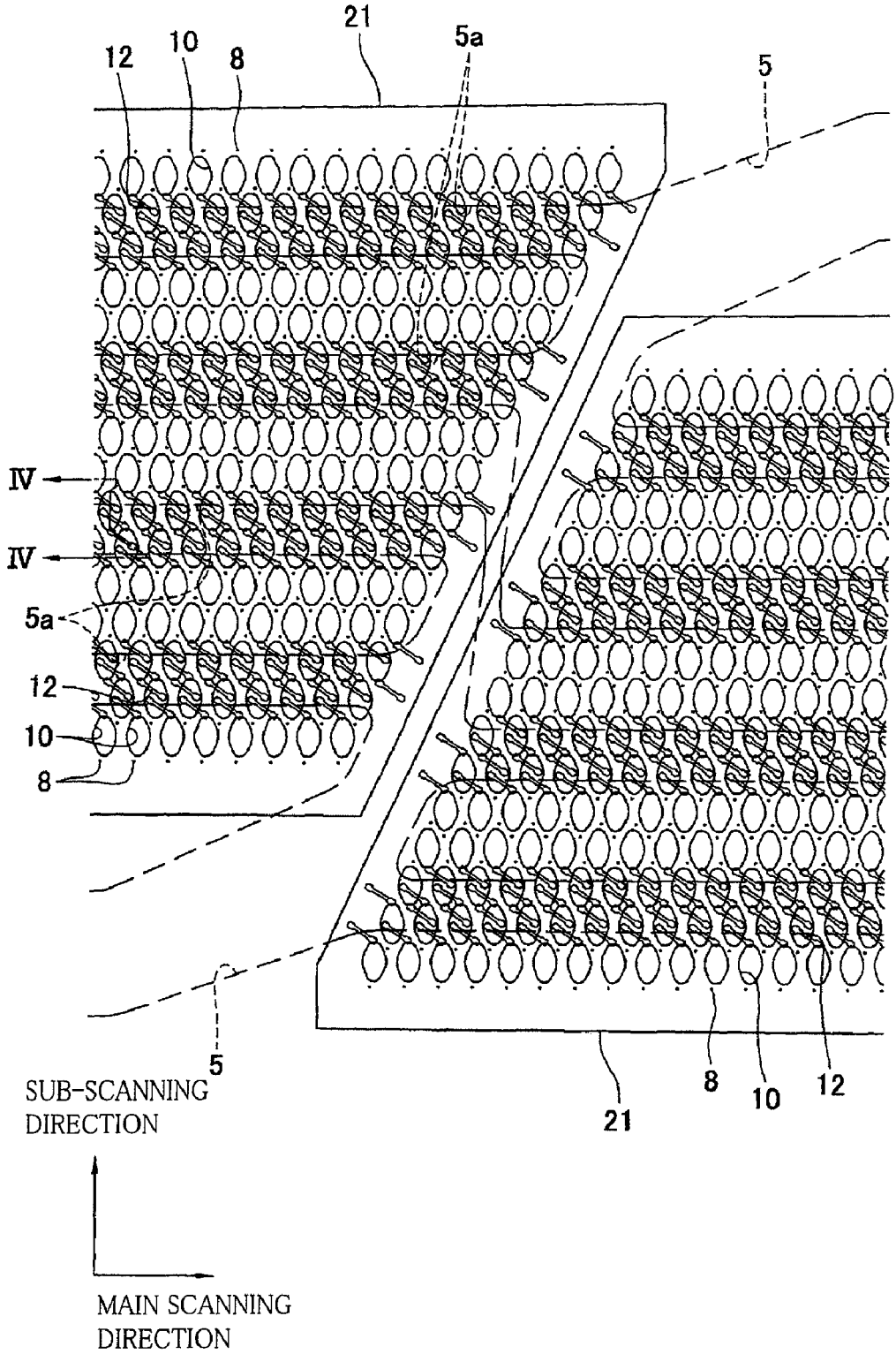
FIG. 3 is an enlarged plan view of an area III enclosed with one-dot chain line in FIG. 2.

As shown in FIG. 3, pressure chambers 10 are respectively opened in areas of an upper surface of the flow-passage unit 4 which respectively correspond to units-bonded areas onto which the actuator units 21 are respectively bonded. The pressure chambers 10 are arranged in matrix and each has a generally rhombic shape. It is noted that, in FIG. 3, nozzles 8 for ejecting the ink, the pressure chambers 10, and apertures 12 are shown in solid lines for easier understanding purposes though originally not seen by being hidden by the actuator units 21. The nozzles 8 are respectively opened in areas of a lower surface of the flow-passage unit 4, i.e., an ink-ejection surface 29*p*, which respectively correspond to the units-bonded areas. Each of the nozzles 8 is a fine opening and, as shown in FIG. 4, communicated with a corresponding one of the pressure chambers 10.

Further, in the upper surface of the flow-passage unit 4, there are formed openings 5*b* which receive the ink supplied from the reservoir units (not shown). The openings 5*b* are arranged in a zigzag or staggered fashion such that each of the openings 5*b* does not overlap any of the units-bonded areas of the actuator units 21. The ink is supplied into the flow-passage unit 4 from the reservoir units via the openings 5*b*.

Figure 2:
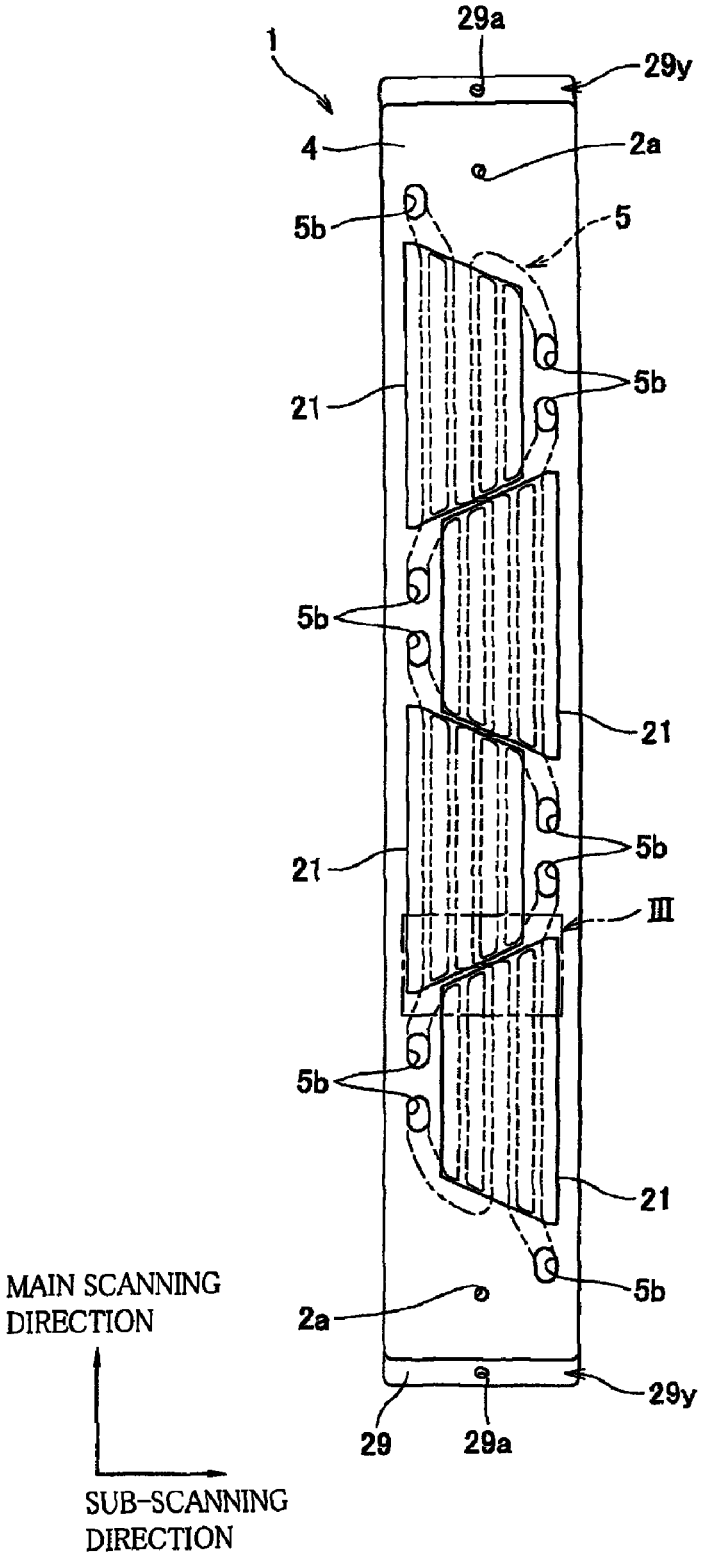
FIG. 2 is a plan view of an ink-jet head.

As shown in FIGS. 2 and 3, in the flow-passage unit 4, there are formed manifolds 5 communicated with the respective openings 5*b*, and sub-manifolds 5*a* branched from the manifolds 5 so as to extend in the unit-bonded areas of the actuator units 21 in a longitudinal direction of the flow-passage unit 4.

Figure 4:
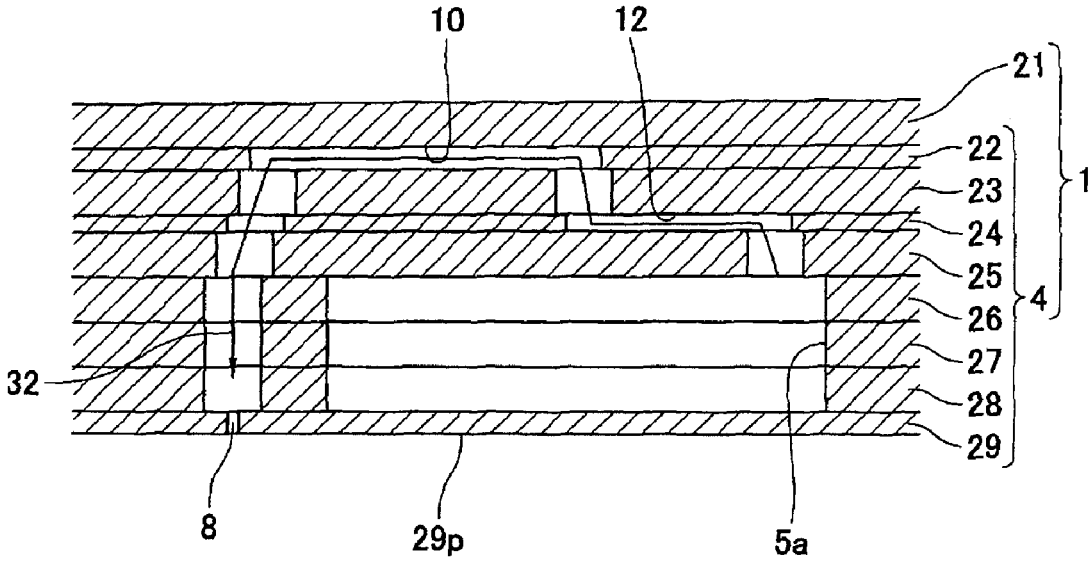
FIG. 4 is a cross-sectional view taken along IV-IV in FIG. 3.

Further, as shown in FIG. 4, in the flow-passage unit 4, there are formed individual flow-passages 32 respectively extending from outlets of the respective sub-manifolds 5*a* to the nozzles 8 via the apertures 12, each functioning as a passage in which an amount of the ink is regulated, and via the pressure chambers 10. That is, the individual flow-passages 32 are formed in the same number as the number of the nozzles 8.

Figure 5:
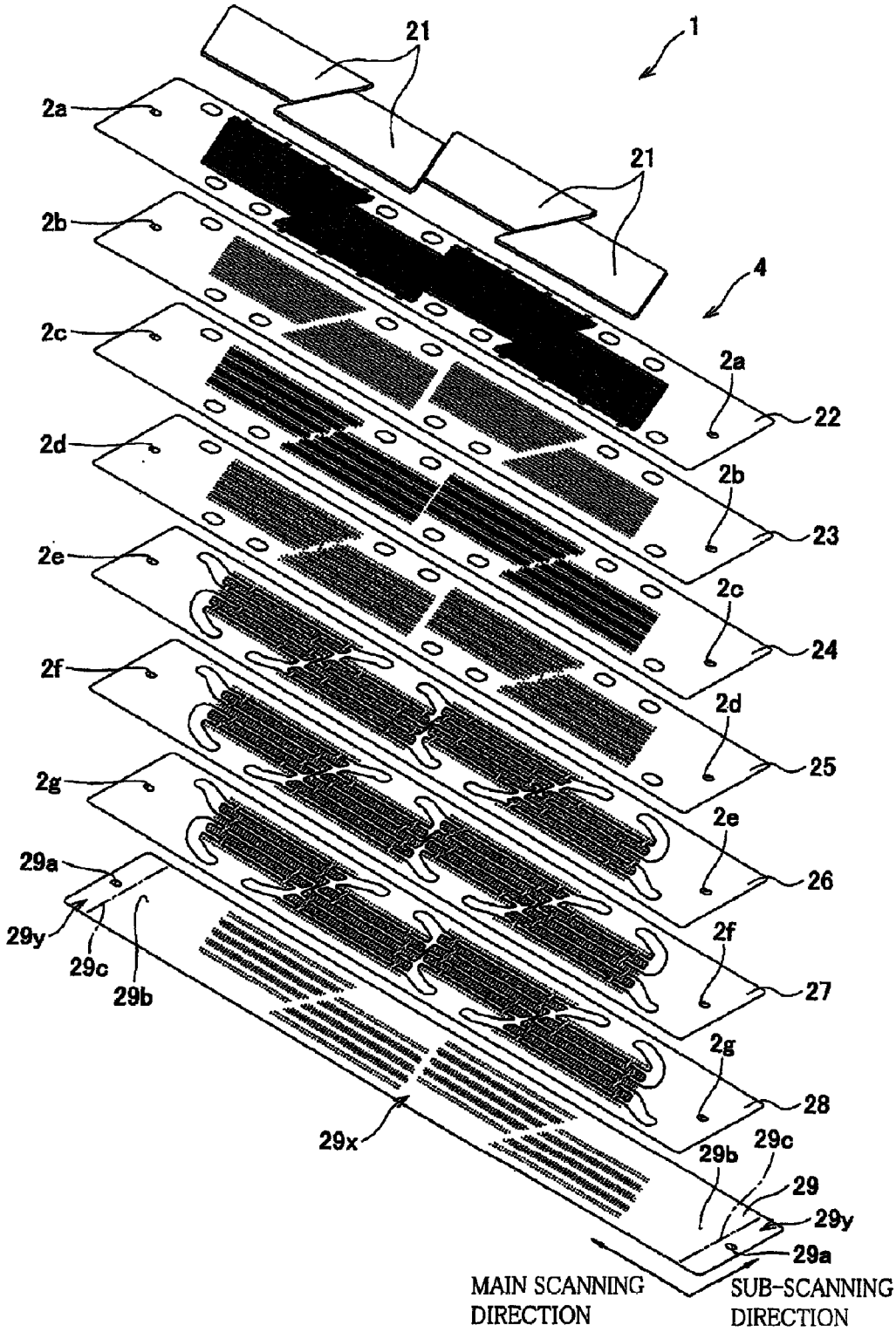
FIG. 5 is an exploded perspective view showing the ink-jet head.

As shown in FIG. 5, the flow-passage unit 4 includes the following eight metal plates stacked on each other in order from the top: a cavity plate 22; a base plate 23; an aperture plate 24; a supply plate 25; manifold plates 26, 27, 28; and a nozzle plate 29 as an outermost plate. Each of the plates 22-29 has a generally rectangular shape elongated in the main scanning direction. The plates 22-28 have the same shape and the same size in plan view and stacked on each other so as to overlap each other. The nozzle plate 29 has a length, in a sub-scanning direction perpendicular to the main scanning direction, which is the same as that of each plate 22-28. Thus, the nozzle plate 29 overlaps the plates 22-28 in the sub-scanning direction. However, the nozzle plate 29 is slightly longer than the plates 22-28 in the main scanning direction, so that, as shown in FIGS. 1 and 2, both of opposite end portions of the nozzle plate 29 in the main scanning direction project from the plates 22-28 as seen from a plates-stack direction in which the plates are stacked on each other.

Hereinafter, an area of the nozzle plate 29 which overlaps the plates 22-28 as seen from the plates-stack direction will be referred to as an overlapping area 29*x* while areas of the nozzle plate 29 which project from the plates 22-28 in the main scanning direction as seen from the plates-stack direction will be referred to as projecting areas 29*y*. That is, as shown in FIG. 5, the nozzle plate 29 includes the overlapping area 29*x*, as a first nozzle plate positioner, in which a plurality of holes respectively functioning as the nozzles 8 are formed, and the two projecting areas 29*y*, each as a second nozzle plate positioner, adjacent to the first area and located at the opposite end portions of the nozzle plate 29 in the main scanning direction so as to interpose the overlapping area 29*x* therebetween. In other words, the projecting areas 29*y* are respectively located on both of opposite sides of the overlapping area 29*x*. Further, a portion of the lower surface of the nozzle plate 29 which corresponds to the overlapping area 29*x* functions as the ink-ejection surface 29*p* in which the plurality of the nozzles 8 are opened.

Figure 9:
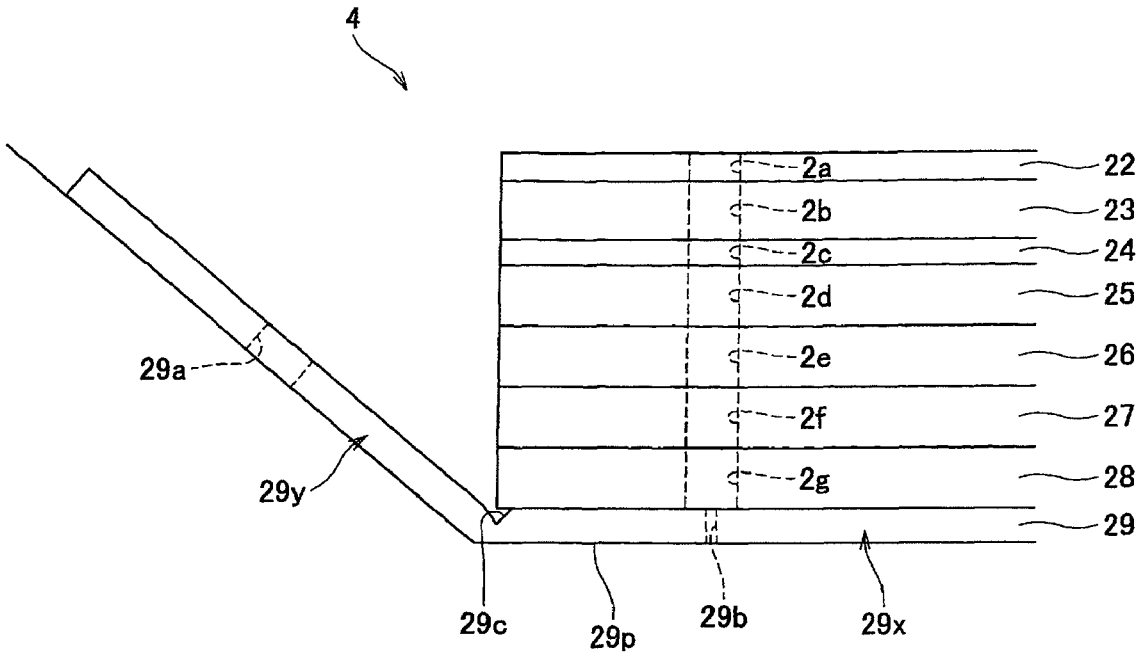
FIG. 9 is a side view partially showing the flow-passage unit in a state in which a nozzle plate is bent.

In the upper surface of the nozzle plate 29, straight cutouts 29*c* are formed respectively at a boundary between the overlapping area 29*x* and one of the projecting areas 29*y* and a boundary between the overlapping area 29*x* and the other of the projecting areas 29*y*. As shown in FIGS. 1 and 9, the nozzle plate 29 is bent along the cutouts 29*c* each as a valley. Thus, the projecting areas 29*y* are nearer to the plate 28 (i.e., an upper surface of the plate 28) than the overlapping area 29*x* in the plates-stack direction. That is, the projections areas 29*y* are located on an upper side of the overlapping area 29*x* in the plates-stack direction. In other words, the projecting areas 29*y* are located on a plate-side of the overlapping area 29*x* in the plates-stack direction, on which side the plate 22-28 are located. An angle between each of the projecting areas 29*y* and the ink-ejection surface 29*p* in the overlapping area 29*x* is obtuse. In a generally center of each of the projecting areas 29*y* in a widthwise direction (i.e., the main scanning direction) of the nozzle plate 29, a provisional positioning hole (i.e., a second nozzle plate positioner) 29*a* which is a round hole having about 1.5 mm in diameter is formed through a thickness of the nozzle plate 29.

As shown in FIG. 5, near each of opposite ends of the overlapping area 29*x* in the main scanning direction, a positioning hole 29*b* (i.e., a plate positioner) which is a round hole having about 20 μm in diameter is formed through a thickness of the nozzle plate 29 in a generally center of the overlapping area 29*x* in the widthwise direction of the nozzle plate 29. Each of the positioning holes 29*b* has the same shape and size as each of the nozzles 8 and has an opening which has the same size as an opening of each nozzle 8 and which is formed in the ink-ejection surface 29*p* as the lower surface of the overlapping area 29*x*.

The provisional positioning holes 29*a* are symmetric with respect to a center of the nozzle plate 29 in the main scanning direction and in the sub-scanning direction as seen in the plates-stack direction. Likewise, the positioning holes 29*b* are also symmetric with respect to the center of the nozzle plate 29 as seen in the plates-stack direction.

In each of the plates 22-28, holes each partly constituting a corresponding one of the individual flow-passages 32 and a corresponding pair of positioning holes (i.e., plate positioners) 2*a*-2*g* are formed through a thickness of each of the plates 22-28. Each pair of positioning holes 2*a*-2*g* respectively correspond to the positioning holes 29*b* of the nozzle plate 29. Each pair of the positioning holes 2*a*-2*g* are formed at a generally center of a corresponding one of the plates 22-28 in a widthwise direction thereof (i.e., the main scanning direction) and respectively in the opposite end portions of the corresponding one of the plates 22-28 in a longitudinal direction thereof. A center of each of the positioning holes 2*a*-2*g* coincides with a center of the corresponding positioning hole 29*b* of the nozzle plate 29. Each of the positioning holes 2*a*-2*g* is a round hole having about 1.5 mm in diameter like the provisional positioning holes 29*a*, and thus larger than the positioning holes 29*b*.

As shown in FIG. 9, a length of each of the projecting areas 29*y* of the nozzle plate 29 in the main scanning direction is longer than a thickness of all the plates 22-29 including the nozzle plate 29. Each of opposite ends of the nozzle plate 29 in the main scanning direction, i.e., one of opposite ends of each of the projecting areas 29*y* which is further from the overlapping area 29*x* than the other is located at the same height in the plates-stack direction as the uppermost plate 22 which is the furthest from the nozzle plate 29 among the plates 22-28. Further, the cutouts 29*c* formed in the upper surface of the nozzle plate 29 face respective ends of the plate 28 stacked on the nozzle plate 29.

Figure 6:
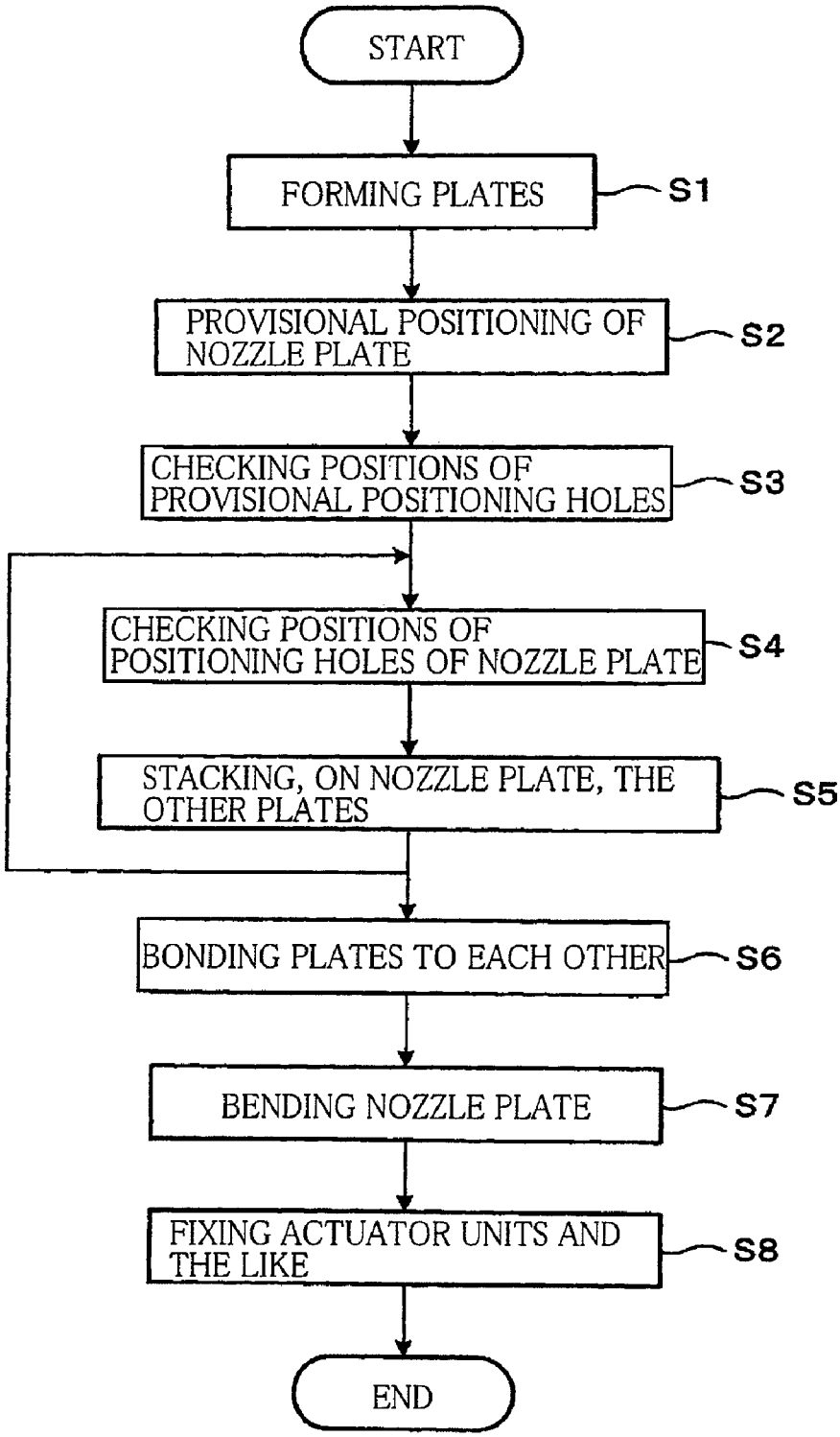
FIG. 6 is a flow-chart showing a method of producing the ink-jet head.

There will be next explained, with reference to FIG. 6, a method of producing the ink-jet head 1.

In producing the ink-jet head 1, the flow-passage unit 4, the four actuator units 21, and the reservoir units (not shown) are separately produced and then joined to each other. Here, a process of producing the flow-passage unit 4 will be explained in detail, but a process of producing each of the actuator units 21 and the reservoir units will be omitted to be explained because, in this ink-jet head 1, the actuator units 21 and the reservoir units are produced in a well-known method.

FIG. 6 is a flow-chart showing the method of producing the ink-jet head 1. Initially in S1, in producing the flow-passage unit 4, eight metal plates are prepared, and holes are formed in each of the plates by press working, etching, or the like, whereby the plates 22-29 are formed. Specifically, the positioning holes 2*a*-2*g* and holes each for partly constituting the corresponding individual flow-passage 32 are formed in the plates respectively to be the plates 22-28 while the nozzles 8, the positioning holes 29*b*, and the provisional positioning holes 29*a* are formed in the plate to be the nozzle plate 29. It is noted that the cutouts 29*c* (with reference to FIG. 5) are formed by half-etching or the like in the upper surface of the nozzle plate 29 at respective boundaries between the areas 29*x*, 29*y* before the nozzles 8 and the holes 29*b*, 29*b* are formed.

Figure 7:
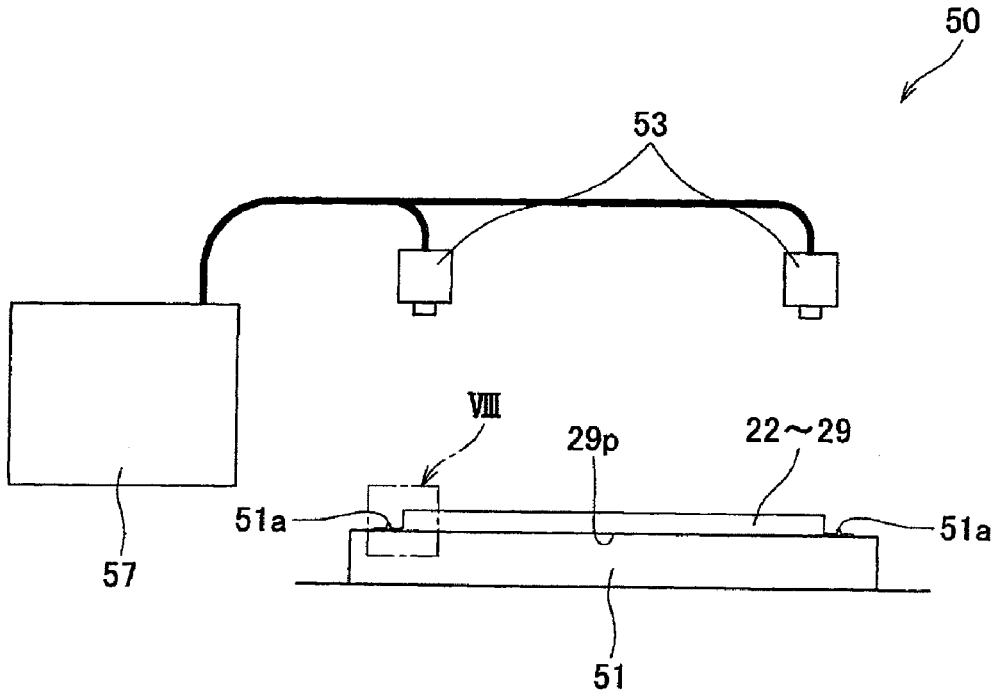
FIG. 7 is a side view schematically showing a plate stacking device used in a process of producing a flow-passage unit included in the ink-jet head.

Next in S2, the nozzle plate 29 is placed on a support table 51 of a plate stacking device 50 shown in FIG. 7 while a pair of positioning pins 51*a* provided on and projected from the support table 51 are respectively inserted into or set to the provisional positioning holes 29*a*. In this time, the nozzle plate 29 is placed on the support table 51 such that the lower surface of the nozzle plate 29 which includes the ink-ejection surface 29*p* contacts with an upper surface of the support table 51. This operation, i.e., an operation in which only the nozzle plate 29 is positioned to the support table 51 and the like will be referred to as a "provisional positioning operation".

As shown in FIG. 7, the plate stacking device 60 includes the support table 51, two cameras 53, camera moving mechanisms (not shown), and a controller 57. The support table 51 supports the plates 22-29. The cameras 63 are disposed above the support table 51 so as to be distant from each other in a horizontal direction and in the main scanning direction. The camera moving mechanisms respectively move the cameras 53 in the horizontal direction. The controller 57 is connected to the cameras 53 and the camera moving mechanisms and receives image-pickup signals from the respective cameras 53. On the basis of the image-pickup signals, the controller 57 controls the camera moving mechanisms as needed such that the cameras 53 are moved in the horizontal direction.

Figure 8:
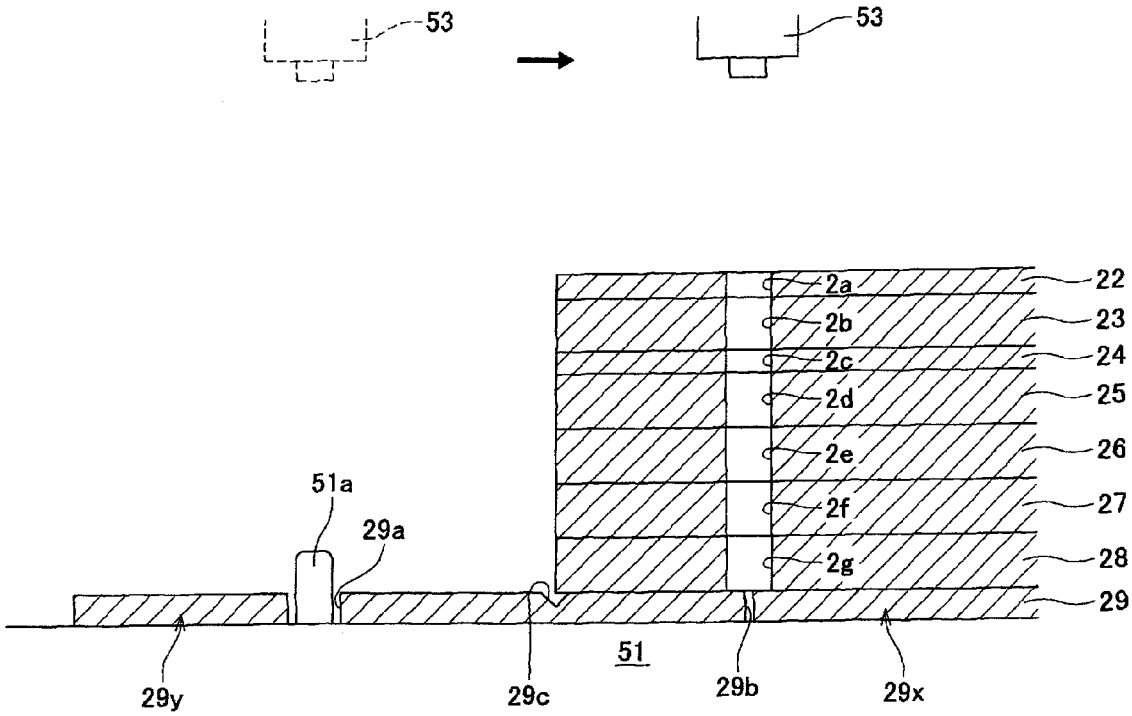
FIG. 8 is a side view in cross-section schematically showing an area VIII enclosed with one-dot chain line in FIG. 7.

The positioning pins 51*a* provided on the support table 51 are distant from each other in a distance the same as that between the provisional positioning holes 29*a* and, as shown in FIG. 8, each has a slightly smaller diameter than the corresponding provisional positioning hole 29*a* such that each positioning pin 51*a* is insertable into the corresponding provisional positioning hole 29*a* even where error in respective positions at which the provisional positioning holes 29*a* are formed is somewhat generated. In S2, the cameras 53 are fixed just above the positioning pins 51*a* as illustrated by dotted lines in FIG. 8. It is noted that FIG. 8 shows one of the cameras 53. Each of the cameras 53 has a field of view of approximately 0.2 mm×0.2 mm, for example.

After the nozzle plate 29 is placed on the support table 51 in S2, the controller 57 receives a start signal on the basis of an operation of a user with the plate stacking device 50, for example, and receives the image-pickup signals from the cameras 53. Then, on the basis of the image-pickup signals, the controller 57 checks in S3 respective positions of the provisional positioning holes 29*a*.

In S3, where each of the provisional positioning holes 29*a* is within the field of view of the corresponding camera 53, the controller 57 judges that the provisional positioning holes 29*a* are just under the respective cameras 53 on the basis that the cameras 53 pick up images of the respective provisional positioning holes 29*a*. On the other hand, where the controller 57 judges that each provisional positioning hole 29*a* is not within the field of view of the corresponding camera 53 on the basis that the images of the respective provisional positioning holes 29*a* are not picked up by the cameras 53, the controller 57 controls the camera moving mechanisms such that the cameras 53 are moved in the horizontal direction. Then, the controller 57 receives the image-pickup signals from the cameras 53 at every predetermined moving distance. When the cameras 53 pick up the respective images of the provisional positioning holes 29*a*, and the controller 57 receives the image-pickup signals indicating the pick-up of the images, respective positions of the cameras 53 are provisionally fixed, and the checking operation in S3 is finished.

After the operation in S3, the controller 57 controls the camera moving mechanisms such that the cameras 53 are moved closer to each other (in a direction indicated by arrow in FIG. 8) by a distance equal to that between each provisional positioning hole 29*a* and the corresponding positioning hole 29*b*. As a result, as indicated by solid lines in FIG. 87 each camera 53 positions approximately just above the corresponding positioning hole 29*b*. Then, the controller 57 receives the image-pickup signals respectively from the cameras 53, and, in S4, checks the respective positions of the positioning holes 29*b* on the basis of the image-pickup signals.

In S4, like in S3, where each of the positioning holes 29*b* is within the field of view of the corresponding camera 53, the controller 57 judges that the positioning holes 29*b* are just under the respective cameras 53 on the basis that the cameras 53 pick up images of the respective positioning holes 29*b*. On the other hand, where the controller 57 judges that each positioning hole 29*b* is not within the field of view of the corresponding camera 53 on the basis that the images of the respective positioning holes 29*b* are not picked up by the cameras 53, the controller 57 controls the camera moving mechanisms such that the cameras 53 are moved in the horizontal direction. Then, the controller 57 receives the image-pickup signals from the cameras 53 at every predetermined moving distance. When the cameras 53 pick up the respective images of the positioning holes 29*b*, and the controller 57 receives the image-pickup signals indicating the pick-up of the images, respective positions of the cameras 53 are fixed, and the checking operation in S4 is finished.

After the operation in S4, the plates 22-28 each of whose lower surface is covered with an adhesive are stacked, in S5, on the nozzle plate 29 in order. In this operation, the manifold plate 28 is initially stacked on the nozzle plate 29 while the user visually checks such that centers of the respective positioning holes 2*g* respectively coincide with centers of the respective positioning holes 29*b* of the nozzle plate 29. Then, the controller 57 checks whether the centers of the respective positioning holes 2*g* respectively coincide with the centers of the respective positioning holes 29*b* by the respective cameras 58 of the plate stacking device 50. Where the centers of the respective positioning holes 2*g* respectively do not coincide with or are respectively deviated from the centers of the respective positioning holes 29*b*, a position of the plate 28 is adjusted by moving the plate 28 manually or by a suitable moving mechanism until the deviation falls within tolerance limit. Each of the plates 22-27 disposed on an upper side of the manifold plate 28 is stacked while adjusting in the above-described manner such that centers of the respective positioning holes formed in each of the plates 22-27 respectively coincide with the centers of the respective positioning holes 29*b* and such that the centers of the respective positioning holes formed in each of the plates 22-27 respectively coincided with centers of the respective positioning holes of the plate just under each plate.

After the operation in S5, the plates 22-29 are adhered or bonded to each other in S6. It is noted that the plates 22-29 are fixed to each other in a certain degree in S4 by the adhesives with which the lower surfaces of the plates 22-28 are respectively covered, but are strongly fixed to each other in S6 by being heated while being pressurized.

After the operation in S6, the positioning pins 51*a* are respectively removed from the provisional positioning holes 29*a*, a precursor of the flow-passage unit 4 constituted by the plates 22-29 fixed to each other is moved away from the support table 51. Then, as shown in FIG. 9, the nozzle plate 29 is bent in S7 along the cutouts 29*c* each as the valley such that the projecting areas 29*y* formed at the opposite ends of the nozzle plate 29 in a longitudinal direction thereof are moved upward and the angle between each of the projecting areas 29*y* and the ink-ejection surface 29*p* is obtuse. As a result, the flow-passage unit 4 is completed.

Then, the ink-jet head 1 is completed after processes in S8 in which the four actuator units 21 are fixed onto the flow-passage unit 4, each terminal of the FPC is connected to the actuator units 21, the reservoir units are fixed to the flow-passage unit 4, the controlling board is further fixed at a position above the reservoir units, and so on.

As described above, according to this ink-jet head 1, the provisional positioning operation of the nozzle plate 29 can be performed using the provisional positioning holes 29*a* formed in the projecting areas 29*y* of the nozzle plate 29, so that the plates 22-29 can be positioned to each other using the positioning holes 29*b* formed in the overlapping area 29*x*. In this ink-jet head 1, each provisional positioning hole 29*a* is formed to have the size in which the corresponding positioning pin 51*a* is insertable into the provisional positioning hole 29*a* while the positioning holes 29*b* opened in the ink-ejection surface 29*p* are respectively formed to be smaller than the provisional positioning holes 29*a*, whereby intrusion of the ink into the positioning holes 29*b* of the nozzle plate 29 in a wiping operation can be reduced, and a wiper can be less damaged and deteriorated in the wiping operation. Specifically, the respective openings of the positioning holes 29*b* which are formed in the ink-ejection surface 29*p* are relatively small. Thus, even if the ink raked by the wiper is intruded into the holes 29*b*, the ink is prevented from intruded further inwardly by a meniscus of the ink in each of the holes 29*b*. Further, since a distal end of the wiper less contacts with respective opening edges of the positioning holes 29*b*, the wiper is prevented from being damaged and deteriorated.

Further, according to the method of producing this ink-jet head 1, in addition to the effects as described above, since the provisional positioning holes 29*a* are relatively large, even where the cameras 53 each having a relatively small field of view are used like in this ink-jet head 1, for example, the check of the provisional positioning holes 29*a* can be easily performed.

Since the positioning holes 29*b* of the nozzle plate 29 respectively have the openings in the ink-ejection surface 29*p* which have the same size as the nozzles 8, the intrusion of the ink into the holes 29*b* and the damage and deterioration of the wiper in the wiping operation are reduced more effectively. Further, according to this method, the positioning holes 29*b* are formed by the press working or the like in the operation in which the nozzles 8 are formed. This leads to a simple producing process and a reduced cost.

Since the provisional positioning holes 29*a* are respectively formed in the projecting areas 29*y* respectively provided at the opposite ends of the nozzle plate 29 in the main scanning direction, the provisional positioning operation of the nozzle plate 29 in S2 using the provisional positioning holes 29*a* can be performed more accurately.

Further, the provisional positioning holes 29*a* are disposed so as to be symmetric with respect to the center of the nozzle plate 29 as seen in the plates-stack direction while the positioning holes 29*b* of the nozzle plate 29 are disposed near the respective opposite ends of the overlapping area 29*x* so as to be symmetric with respect to the center of the nozzle plate 29. Thus, since the nozzle plate 29 can also be used when turned in a 180-degree, a limitation of a positional relationship of the nozzle plate 29 with respect to the other plates 22-28 is removed. Further, both of the provisional positioning holes 29*a* and the positioning holes 29*b* are disposed symmetrically, the provisional positioning operation of the nozzle plate 29 in S2 using the provisional positioning holes 29*a* and the positioning of the plates 22-29 relative to each other in S5 can be performed more simply and accurately.

As shown in FIG. 9, the angle between each of the projecting areas 29*y* and the ink-ejection surface 29*p* is obtuse. For example, where each of the projecting areas 29*y* extends along end surfaces of the plates 22-28 and is perpendicular to the ink-ejection surface 29*p*, there may arise a problem in which the distal end of the wiper may contact with corner portions of the nozzle plate 29 in the wiping operation and thus damaged and deteriorated. However, in this ink-jet head 1, since the leading end of the wiper can be smoothly introduced to the ink-ejection surface 29*p*, the problem can be avoided.

Each pair of positioning holes 2*a*-2*g* of the respective plates 22-28 different from the nozzle plate 29 are larger than the positioning holes 29*b* of the nozzle plate 29. That is, in order to reduce the intrusion of the ink into the positioning holes 29*b* of the nozzle plate 29 and the damage and deterioration of the wiper in the wiping operation, this ink-jet head 1 is configured such that the positioning holes 29*b* are formed to be relatively small while each pair of positioning holes 2*a*-2*g* of the respective plates 22-28 different from the nozzle plate 29 are larger than the positioning holes 29*b* of the nozzle plate 29. This facilitates forming of the holes and checking of the positions of the respective holes.

The cutouts 29*c* are formed in the nozzle plate 29 respectively at the boundary between the overlapping area 29*x* and one of the projecting areas 29*y* and the boundary between the overlapping area 29*x* and the other of the projecting areas 29*y*. The cutouts 29*c* facilitate the operation in S7 in which the nozzle plate 29 is bent.

Since the cutouts 29*c* are formed in the upper surface of the nozzle plate 29, contact of the distal end of the wiper with the cutouts 29*c* in the wiping operation can be avoided, thereby preventing the damage and deterioration of the wiper.

Since the cutouts 29*c* face the respective ends of the plate 28 stacked on the nozzle plate 29, the operation in which the nozzle plate 29 is bent can be easily and certainly performed with the ends each acting as a fulcrum and using the cutouts 29*c*.

Each of the opposite ends of the nozzle plate 29 in the main scanning direction, i.e., the one of opposite ends of each of the projecting areas 29*y* which is further from the overlapping area 29*x* than the other is located at the same height in the plates-stack direction as the uppermost plate 22 which is the furthest from the nozzle plate 29 among the plates 22-28. This restricts contact of the distal end of the wiper with the opposite ends of the nozzle plate 29 in the wiping operation, thereby preventing the wiper from being damaged and deteriorated.

It is to be understood that the above-described first embodiment is only by way of example, and the invention may be otherwise embodied with various modifications without departing from the scope and spirit of the invention.

For example, in the above-described ink-jet head 1, the plate stacking device 50 is used in the process for producing the flow-passage unit 4. However, the ink-jet printer 1 is not limited to this configuration, and other suitable devices may be used. Further, in S3 and S4, the checks may be performed directly and visually without using the cameras 53 and may be performed using other devices such as a microscope.

In the above-described ink-jet head 1, the cameras 53 included in the plate stacking device 50 shown in FIG. 7 are movable in the horizontal direction. In this respect, the controller 57 adjusts the respective positions of the cameras 53 in the horizontal direction in the checking process in S3 and S4 shown in FIG. 6, and the controller 57 controls the cameras 53 to move in the horizontal direction from the respective positions above the provisional positioning holes 29*a* to the respective positions above the positioning holes 29*b* when performing the operations in S4 after S3. However, from a viewpoint of avoiding a reduction in an accuracy of detecting the respective positions of the cameras 53 due to the movement thereof, there may be employed a method in which the cameras 53 are respectively fixed to predetermined positions without moving. Hereinafter, there will be explained an example of the method with reference to FIGS. 10 and 11.

Figure 10:
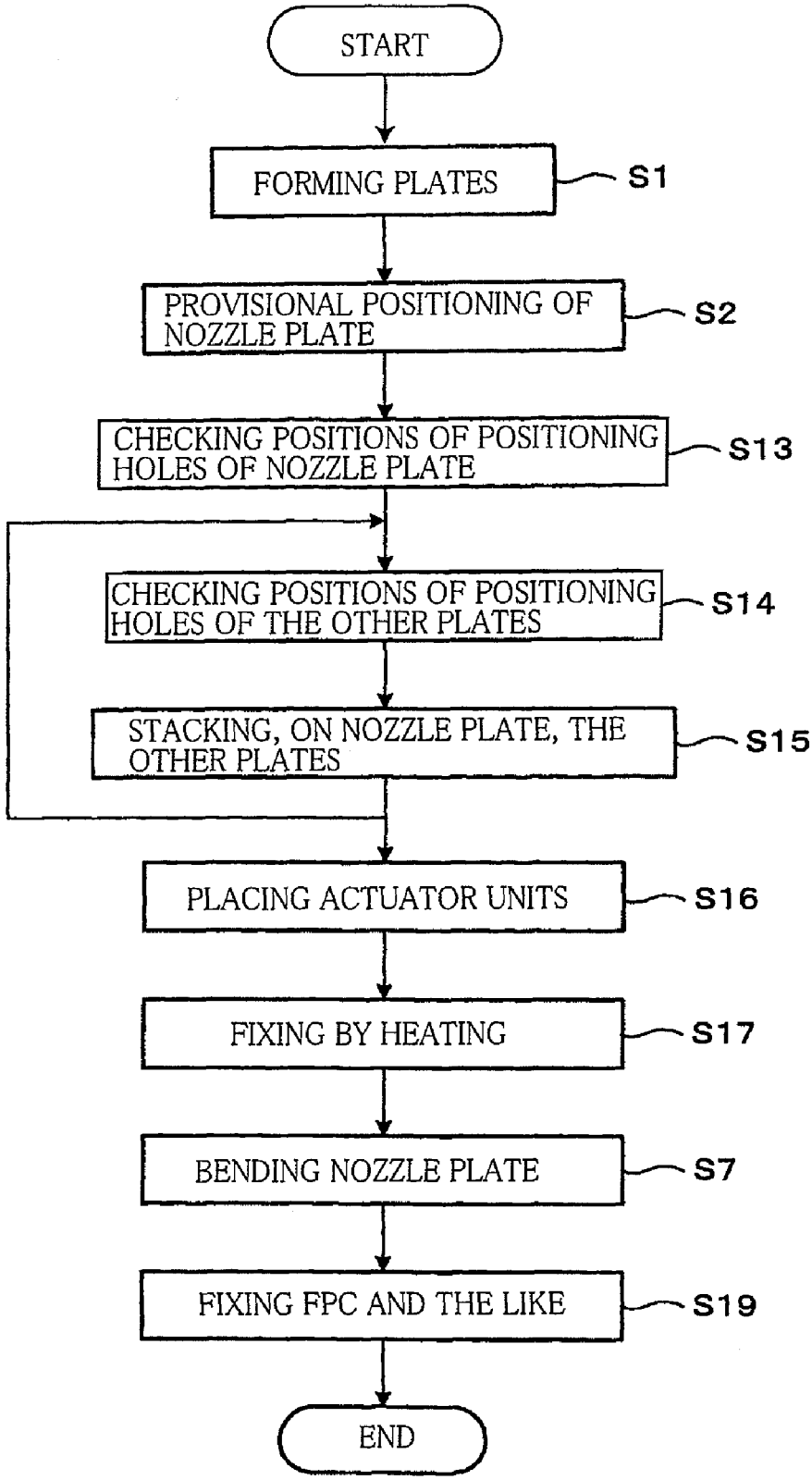
FIG. 10 is a flow-chart showing a second embodiment indicating the method of producing the ink-jet head.
Figure 11:
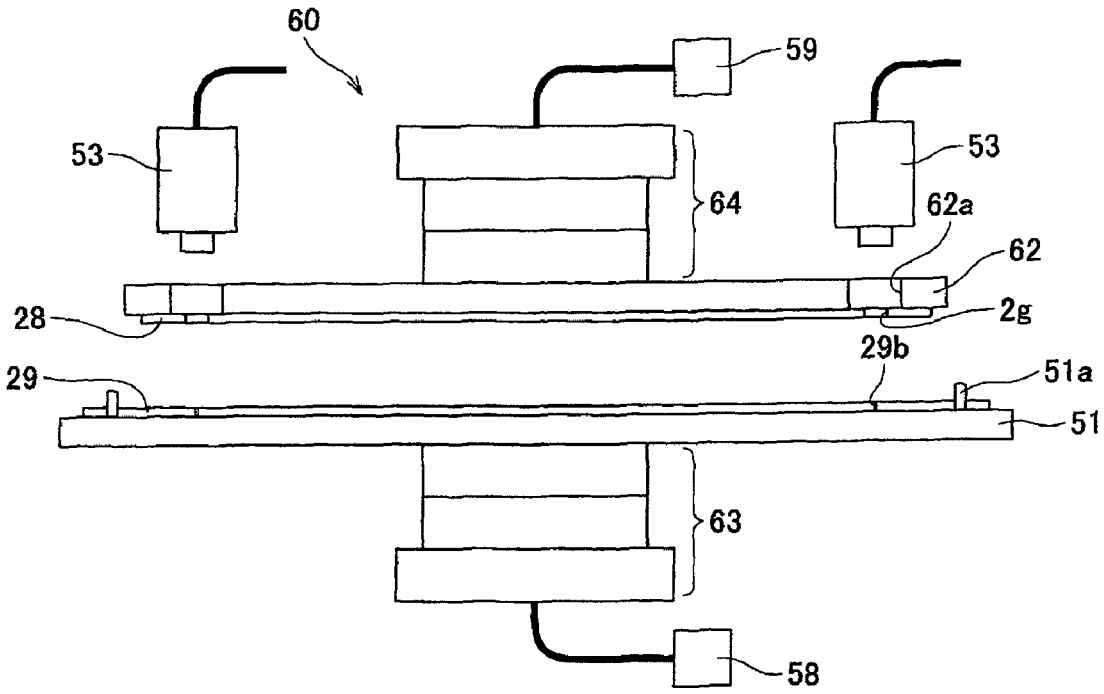
FIG. 11 is a side view schematically showing a plate stacking device used in a process of producing the flow-passage unit in the method shown in FIG. 10.

FIG. 10 is a flow-chart showing a second embodiment indicating the method of producing the ink-jet head. FIG. 11 is a side view schematically showing a plate stacking device used in a process of producing the flow-passage unit in the method shown in FIG. 10. In FIGS. 10 and 11, the same reference numerals as used in FIGS. 6 and 7 are used to identify the corresponding components, and a detailed explanation of which is dispensed with.

As shown in FIG. 11, a plate stacking device 60 used in this second embodiment includes, in addition to the support table 51 in FIG. 7 and the cameras 53 respectively fixed to the predetermined positions, a stage 63, a controller 58, a support table 62, a stage 64, and a controller 59. The stage 63 supports the support table 51 and is movable along an x-axis and a y-axis, and about a θ-axis (i.e., a rotational axis) in a horizontal plane by a first moving mechanism (not shown). The controller 58 executes a control of the first moving mechanism. The support table 62 is located above the support table 51 and supports or holds the plates 22-29 in order by sucking, holding or the like, for example. The stage 64 supports the support table 62 and is movable along the x-axis and the y-axis, and about the θ-axis (i.e., the rotational axis) in the horizontal plane by a second moving mechanism (not shown). The controller 59 executes a control of the second moving mechanism.

The controllers 58, 59 respectively receive the image-pickup signals from the cameras 53, and respectively control the first and second moving mechanisms on the basis of the image-pickup signals. Thus, a position of the support table 51 supported by the stage 63 and a position of the support table 62 supported by the stage 64 in the horizontal direction are adjusted.

At positions respectively just above the positioning holes 29*b* formed in the nozzle plate 29, through holes 62*a* each having a slightly larger size than the positioning holes 2*a*-2*g* are formed through a thickness of the support table 62. When the support tables 51, 62 are disposed at respective specific positions in the horizontal direction, the cameras 53 respectively disposed above the through holes 62*a* of the support table 62 can pick up, through the respective through holes 62*a*, respective images of (a) the positioning holes 2*g* formed in the plate 28 supported on the support table 62 and (b) the positioning holes 29*b* formed in the plate 29 on the support table 51.

In the producing method of this modification, as shown in FIG. 10, the operations in S1 and S2 which are the same as those shown in FIG. 6 are initially performed for producing the flow-passage unit 4. Here, before the nozzle plate 29 is placed on the support table 51 in S2, the nozzle plate 29 is supported on, e.g., a provisional support table (not shown) at three portions of the nozzle plate 29 which have a specific positional relationship with respect to the provisional positioning holes 29*a*, for example. As a result, the nozzle plate 29 on the provisional table can be easily placed on the support table 51 by being sucked or held by the support table 62 and being carried while being supported by the support table 62.

After the operation in S2, the respective positions of the positioning holes 29*b* of the nozzle plate 29 are checked in S13 by the cameras 53. In this time, where each positioning hole 29*b* is not within the field of view of the corresponding camera 53, the controller 58 controls the first moving mechanism such that the stage 63 is moved in the horizontal direction, thereby adjusting the position of the support table 51 in the horizontal direction. As a result, the support table 51 is positioned such that each positioning hole 29*b* is located within the field of view of the corresponding camera 53.

After the operation in S13, the manifold plate 28 supported by the provisional table (not shown) is sucked and supported by the support table 62 in a state in which the positioning holes 2*g* of the plate 28 and the through holes 62*a* of the support table 62 respectively face each other. Then, during moving of the plate 28 to a lower side of the cameras 53 in a state in which the plate 28 is supported by the support table 62, the lower surface of the plate 28 is covered with the adhesive. Thereafter, as shown in FIG. 11, the support table 62 is disposed on the lower side of the cameras 53, and, in S14, the respective positions of the positioning holes 2*g* of the plate 28 are checked through the respective cameras 53. In this time, where each positioning hole 2*g* is not within the field of view of the corresponding camera 53, the controller 59 controls the second moving mechanism such that the stage 64 is moved in the horizontal direction, thereby adjusting a position of the support table 62 in the horizontal direction. As a result, the support table 62 is positioned in the horizontal direction such that each positioning hole 2*g* is within the field of view of the corresponding camera 53 and such that the respective centers of the holes 2*g* and the respectively centers of the holes 29*b* respectively coincide with each other.

After the operation in S14, the support table 62 is moved downward until the plate 28 contacts with the upper surface of the nozzle plate 29, and, for example, the plate 28 is released from the support table 62 by removing a sucking (holding) force of the support table 62, and, in S15, the plate 28 is stacked on the nozzle plate 29.

the plates 22-29 constituting the flow-passage unit 4 are stacked on each other by repeating operations like the above-described operations in S14 and S15 for the plates 22-27 on the upper side of the manifold plate 28.

Then, the positioning pins 51*a* are respectively removed from the provisional positioning holes 29*a*, and the precursor of the flow-passage unit 4 constituted by the plates 22-29 is moved away from the support table 51. Then, in S16, the four actuator units 21 are placed on the precursor of the flow-passage unit 4 with the adhesive interposed therebetween.

After the operation in S16, the precursor on which the actuator units 21 are placed is heated at a predetermined temperature, whereby the adhesives between the plates 22-29 and the adhesive with which the actuator units 21 are covered are solidified. As a result, in S17, the plates 22-29 are strongly bonded and fixed to each other, and the actuator units 21 fixed onto the cavity plate 22.

After the operation in S17, like the above-described method, in S7, the projecting areas 29*y* of the nozzle plate 29 are bent. As a result, the flow-passage unit 4 is completed. Then, the ink-jet head 1 is completed after processes in S19 in which each terminal of the FPC is connected to the actuator units 21, the reservoir units are fixed to the flow-passage unit 4, the controlling board is further fixed at a position above the reservoir units, and so on.

In view of the above, the positioning holes 29*b* of the nozzle plate are for positioning the nozzle plate 29 with respect to the plates 22-28. The provisional positioning holes 29*a* are for positioning the nozzle plate 29 with respect to the support table 51. The positioning holes 2*a*-2*g* of each plate 22-28 are for positioning each plate 22-28 with respect to the nozzle plate 29 and the other of the plates 22-28.

It is noted that, in the producing methods shown in FIGS. 6 and 10, the plates 22-28 are stacked on the nozzle plate 29 in order, but these methods are not limited to this operation. For example, a stacked body may be produced by stacking the plates 22-28 different from the nozzle plate 29 on each other in advance in another process and then may be stacked on the nozzle plate 29 at one time.

The number of plates constituting the ink-jet head 1 is not limited to eight. For example, the number of plates other than the nozzle plate 29 is not limited to seven. That is, the number may be more than one.

A shape of each of the positioning holes 29*b* of the nozzle plate 29 is not limited to a shape having a constant diameter along the thickness of the plate 29. For example, the shape may be a shape having a diameter gradually decreased from the upper surface of the nozzle plate 29 toward the lower surface thereof. Further, a size of the opening of each positioning hole 29*b* formed in the ink-ejection surface 29*p* is not limited to be the same as that of each nozzle 8. In order to reduce the damage and deterioration of the wiper, the opening may be smaller than each nozzle 8.

In the ink-jet head 1 described above, each of the positioning holes 29*b* of the nozzle plate 29 is the hole formed through the nozzle plate 29, but the ink-jet head 1 is not limited to this configuration. That is, each positioning hole 29*b* may be in the form of a recess which is not formed through the nozzle 29 and may be in the form of a cutout partly opened in a corresponding one of side faces of the nozzle plate 29. Further, each positioning hole 29*b* may be formed by a mark which can be checked through the corresponding positioning holes 2*a*-2*g*, without changing a shape of the nozzle plate.

In the ink-jet head 1 described above, the center of each of the positioning holes 2*a*-2*g* coincides with the center of the corresponding positioning hole 29*b* of the nozzle plate 29 in the plates-stack direction, but the ink-jet head 1 is not limited to this configuration. That is, it is sufficient that each of the positioning holes 2*a*-2*g* at least partly overlaps the corresponding positioning hole 29*b* in the plates-stack direction.

The projecting areas 29*y* are not limited to be provided at respective opposite end portions of the nozzle plate 29 in the main scanning direction, and may be provided at respective opposite end portions of the nozzle plate 29 in the sub-scanning direction. Further, only one projecting area 29*y* may be provided in the nozzle plate 29.

The provisional positioning holes 29*a* and the positioning holes 29*b* of the nozzle plate 29 may be asymmetric with respect to the center of the nozzle plate 29. For example, at least one is enough for the number of each of the provisional positioning hole 29*a* and the positioning hole 29*b*. Further, the positioning holes 29*b* are not limited to be positioned near the respective opposite ends of the overlapping area 29*x* of the nozzle plate 29.

In the ink-jet head 1 described above, each of the provisional positioning holes 29*a* of the nozzle plate 29 is the hole formed through the nozzle plate 29, but the ink-jet head 1 is not limited to this configuration. For example, each provisional positioning hole 29*a* may be in the form of a cutout partly opened in a corresponding one of the side faces of the nozzle plate 29.

The angle between each of the projecting areas 29*y* and the ink-ejection surface 29*p* is not limited to be obtuse. In order to reduce the size of the ink-jet head 1, the projecting areas 29*y* may be extend along the end surfaces of the plates 22-28 and be perpendicular to the ink-ejection surface 29*p*.

Each of the positioning holes 2*a*-2*g* formed in the corresponding one of the plates 22-28 different from the nozzle plate 29 is not limited to be larger than each positioning hole 29*b* of the nozzle plate 29, and not limited to be the same size as each provisional positioning hole 29*a* of the nozzle plate 29. For example, each of the positioning holes 2*a*-2*g* may be the same size as each positioning hole 29*b*.

The cutouts 29*c* may be formed in the lower surface of the nozzle plate 29 and may not face the respective ends of the plate 28 stacked on the nozzle plate 29. Further, the nozzle plate 29 may be bent along the cutouts 29*c* each as a mountain. Furthermore, the cutouts 29*c* may be omitted.

Each of the opposite ends of the nozzle plate 29 in the main scanning direction may not be located at the same height as the uppermost plate 22.

The liquid ejection head according to the present invention is not limited to be elongated in one direction. Further, the liquid ejection head according to the present invention is applicable to other types of ink-jet heads such as a line-type head and a serial-type head, and is used for various recording devices such as a printer, a facsimile, and a copying machine.

What is claimed is:

1. A liquid ejection head, comprising:

a plurality of plates including a nozzle plate in which a plurality of nozzles for ejecting liquid are formed, and stacked on each other with the nozzle plate being as an outermost plate, wherein the nozzle plate includes (a) a first area in which the plurality of nozzles are formed and (b) a second area adjacent to the first area and located on a plate-side of the first area in a plates-stack direction in which the plurality of plates are stacked on each other, on which plate-side at least one of the plurality of plates different from the nozzle plate is located, wherein the nozzle plate further includes (a) a first nozzle plate positioner formed in the first area of the nozzle plate and (b) a second nozzle plate positioner larger than the first nozzle plate positioner and formed in the second area of the nozzle plate, and wherein each of the at least one of the plurality of plates different from the nozzle plate includes a plate positioner formed therein and at least partly overlapping the first nozzle plate positioner in the plates-stack direction.

2. The liquid ejection head according to claim 1, wherein each of the first nozzle plate positioner, the second nozzle plate positioner, and the plate positioner is a hole formed through a corresponding one of the plurality of plates.

3. The liquid ejection head according to claim 2, wherein the first nozzle plate positioner is configured to position the nozzle plate with respect to the at least one of the plurality of plates different from the nozzle plate, wherein the second nozzle plate positioner is configured to positioning the nozzle plate, and wherein the plate positioner is configured to positioning each of the at least one of the plurality of plates with respect to the nozzle plate.

4. The liquid ejection head according to claim 1, wherein the first nozzle plate positioner includes an opening opened in the first area and having the same size as an opening of each of the plurality of nozzles.

5. The liquid ejection head according to claim 1, wherein a plurality of second areas each as the second area are respectively located on both of opposite sides of the first area, and wherein a plurality of second nozzle plate positioners each as the second nozzle plate positioner are respectively formed in the plurality of second areas.

6. The liquid ejection head according to claim 5, wherein the plurality of second nozzle plate positioners are formed so as to be symmetric with respect to a center of the nozzle plate as seen in the plates-stack direction, and wherein a plurality of first nozzle plate positioners each as the first nozzle plate positioner are respectively formed in opposite end portions of the first area so as to be symmetric with respect to the center of the nozzle plate as seen in the plates-stack direction.

7. The liquid ejection head according to claim 1, wherein an angle between (a) a surface of the nozzle plate in the first area, which surface is opposite to a surface thereof on which the at least one of the plurality of plates different from the nozzle plate is stacked, and (b) the surface of the nozzle plate in the second area, which surface is continuous with the surface of the nozzle plate in the first area, is obtuse.

8. The liquid ejection head according to claim 1, wherein the plate positioner is larger than the first nozzle plate positioner.

9. The liquid ejection head according to claim 1, wherein a cutout is formed in the nozzle plate at a boundary between the first area and the second area.

10. The liquid ejection head according to claim 9, wherein the cutout is formed in a surface of the nozzle plate on which the at least one of the plurality of plates different from the nozzle plate is stacked.

11. The liquid ejection head according to claim 10, wherein the cutout faces an end of one of the at least one of the plurality of plates which is stacked on the nozzle plate.

12. The liquid ejection head according to claim 1, wherein the nozzle plate has an end in one of opposite end portions of the second area, the one being further from the first area than the other, and wherein the end of the nozzle plate is located at the same height in the plates-stack direction as one of the plurality of plates which is the furthest from the nozzle plate among the at least one of the plurality of plates different from the nozzle plate.

13. A method of producing a liquid ejection head, comprising the steps of:

(a) forming a nozzle plate by forming a first nozzle plate positioner and a plurality of nozzles for ejecting liquid in a first area of a plate which is adjacent to a second area of the plate and by forming a second nozzle plate positioner larger than the first nozzle plate positioner in the second area of the plate;

(b) setting a positioning pin to the second nozzle plate positioner;

(c) stacking, on the nozzle plate, at least one plate different from the nozzle plate after step (b) such that a plate positioner formed in each of the at least one plate at least partly overlaps the first nozzle plate positioner;

(d) bonding the plates to each other;

(e) removing the positioning pin from the second nozzle plate positioner after step (d); and (f) bending the nozzle plate after step (e) such that the second area is located on a plate- side of the first area in a plates-stack direction in which the nozzle plate and the at least one plate different from the nozzle plate are stacked on each other, on which plate-side the at least one plate is located.

14. The liquid ejection head according to claim 13, wherein each of the first nozzle plate positioner, the second nozzle plate positioner, and the plate positioner is a hole formed through a corresponding one of the nozzle plate and the at least one plate different from the nozzle plate.

15. The method of producing the liquid ejection head according to claim 13, wherein, in step (a), the first nozzle plate positioner is formed so as to have an opening opened in the first area and having the same size as an opening of each of the plurality of nozzles.

16. The method of producing the liquid ejection head according to claim 13, wherein a plurality of second areas each as the second area are respectively located on both of opposite sides of the first area, wherein, in step (a), a plurality of second nozzle plate positioners each as the second nozzle plate positioner are respectively formed in the plurality of second areas, and wherein, in step (b), a plurality of positioning pins each as the positioning pin are respectively set to the plurality of second nozzle plate positioners.

17. The method of producing the liquid ejection head according to claim 16, wherein, in step (a), the plurality of second nozzle plate positioners and a plurality of first nozzle plate positioners each as the first nozzle plate positioner are formed such that the plurality of second nozzle plate positioners are formed so as to be symmetric with respect to a center of the nozzle plate as seen in the plates-stack direction, and such that the plurality of first nozzle plate positioners are respectively formed in opposite end portions of the first area so as to be symmetric with respect to the center of the nozzle plate as seen in the plates-stack direction.

18. The method of producing the liquid ejection head according to claim 13, wherein, in step (f), the nozzle plate is bent such that an angle between (a) a surface of the nozzle plate in the first area, which surface is opposite to a surface thereof on which the at least one of the plurality of plates different from the nozzle plate is stacked, and (b) the surface of the nozzle plate in the second area, which surface is continuous with the surface of the nozzle plate in the first area, is obtuse.

19. The method of producing the liquid ejection head according to claim 13, wherein, in step (a), the first nozzle plate positioner is formed so as to be smaller than the plate positioner.

20. The method of producing the liquid ejection head according to claim 13, wherein, in step (a), a cutout is formed in the nozzle plate at a boundary between the first area and the second area, and wherein, in step (f), the nozzle plate is bent along the cutout as a mountain or a valley.

21. The method of producing the liquid ejection head according to claim 20, wherein, in step (a), the cutout is formed in a surface of the nozzle plate on which the at least one of the plurality of plates different from the nozzle plate is stacked.

22. The method of producing the liquid ejection head according to claim 21, wherein, in step (a), the cutout is formed so as to face an end of one of the at least one plate which is stacked on the nozzle plate.

23. The method of producing the liquid ejection head according to claim 13, wherein, in step (f), the nozzle plate is bent such that an end of the nozzle plate which is formed in one of opposite end portions of the second area, the one being further from the first area than the other, is located at the same height in the plates-stack direction as one of the at least one plate which is furthest from the nozzle plate among the at least one plate.

24. A method of positioning a plurality of plates constituting a liquid ejection head, the method comprising the steps of:

providing a nozzle plate with a first nozzle plate positioner and a plurality of nozzles for ejecting liquid in a first area and a second nozzle plate positioner that is larger than the first nozzle plate positioner in a second area, the second area being adjacent to the first area;

checking a position of the nozzle plate;

setting a positioning pin to the second nozzle plate positioner; and positioning at least one of the plurality of plates which is different from the nozzle plate and in each of which a plate positioner larger than the first plate positioner of the nozzle plate is formed, with respect to the nozzle plate while checking the positioning hole of the nozzle plate using the positioning hole of the at least one of the plurality of plates such that the plate positioner formed in each of the at least one plate at least partly overlaps the first nozzle plate positioner.

* * * * *